US012234755B2

(12) United States Patent
Kelly et al.

(10) Patent No.: US 12,234,755 B2
(45) Date of Patent: Feb. 25, 2025

(54) METHOD AND PROCESS FOR MANUFACTURING A UNITARY OIL FILTER ADAPTOR

(71) Applicant: RB Distribution, Inc., Colmar, PA (US)

(72) Inventors: Andrew Setz Kelly, Philadelphia, PA (US); Evan Soda, Perkiomenville, PA (US); Gabriel Kovacs, Abington, PA (US); Robert Pisch, Willow Grove, PA (US); Eric Tryson, Willow Grove, PA (US)

(73) Assignee: RB Distribution, Inc., Colmar, PA (US)

( * ) Notice: Subject to any disclaimer, the term of this patent is extended or adjusted under 35 U.S.C. 154(b) by 100 days.

(21) Appl. No.: 18/194,343

(22) Filed: Mar. 31, 2023

(65) Prior Publication Data

US 2023/0243283 A1 Aug. 3, 2023

Related U.S. Application Data

(63) Continuation of application No. 17/985,565, filed on Nov. 11, 2022, now Pat. No. 11,639,675, which is a continuation of application No. 17/528,884, filed on Nov. 17, 2021, now Pat. No. 11,639,674, which is a continuation of application No. 17/406,639, filed on Aug. 19, 2021, now Pat. No. 11,635,005.

(60) Provisional application No. 63/068,759, filed on Aug. 21, 2020.

(51) Int. Cl.
*F01M 11/03* (2006.01)

(52) U.S. Cl.
CPC ..... *F01M 11/03* (2013.01); *F01M 2011/033* (2013.01)

(58) Field of Classification Search
CPC ..... F01M 11/03; F01M 2011/033; B01D 35/30
USPC ..... 123/196 A
See application file for complete search history.

(56) References Cited

U.S. PATENT DOCUMENTS

| | | | |
|---|---|---|---|
| 5,090,376 | A | 2/1992 | Bedi |
| 5,351,664 | A | 10/1994 | Rotter et al. |
| 5,477,817 | A | 12/1995 | Hufendiek et al. |
| 6,884,348 | B2 | 4/2005 | Baumann |
| 8,104,581 | B2 | 1/2012 | Gendermann |
| 10,059,380 | B1 | 8/2018 | Feist et al. |
| 10,195,553 | B2 | 2/2019 | Baxter |
| 10,723,427 | B1 | 7/2020 | Egleston et al. |

(Continued)

FOREIGN PATENT DOCUMENTS

| | | |
|---|---|---|
| CN | 103670584 A | 3/2014 |
| CN | 109611174 A | 4/2019 |

(Continued)

OTHER PUBLICATIONS

S1 B11 14 15 Engine Oct. 2015 Technical Service ("BMW Updated Oct. 2015 Technical Service Bulletin").

(Continued)

*Primary Examiner* — Yi-Kai Wang
(74) *Attorney, Agent, or Firm* — Volpe Koenig

(57) ABSTRACT

A casted unitary metallic oil filter adaptor that has an entirely internal lubricant flow path and threads for connecting associated components directly to the casted adaptor.

18 Claims, 4 Drawing Sheets

(56) References Cited

U.S. PATENT DOCUMENTS

| | | | | |
|---|---|---|---|---|
| 11,339,692 | B2 | 5/2022 | Girondi | |
| 11,635,005 | B2 | 4/2023 | Kelly et al. | |
| 11,639,674 | B2 | 5/2023 | Kelly et al. | |
| 11,639,675 | B2 | 5/2023 | Kelly et al. | |
| 2006/0219208 | A1 | 10/2006 | Chonan et al. | |
| 2007/0068737 | A1* | 3/2007 | Gendermann | F28F 27/02 184/6.22 |
| 2007/0175434 | A1 | 8/2007 | Gruner et al. | |
| 2007/0215307 | A1 | 9/2007 | Kallien | |
| 2009/0194061 | A1 | 8/2009 | Ardes | |
| 2010/0000708 | A1 | 1/2010 | Kiemlen et al. | |
| 2014/0131129 | A1 | 5/2014 | Galsworthy et al. | |
| 2015/0246303 | A1 | 9/2015 | Ben-Shimon et al. | |
| 2016/0318569 | A1 | 11/2016 | Zellmer et al. | |
| 2017/0058729 | A1 | 3/2017 | Lochrane et al. | |
| 2017/0279179 | A1 | 9/2017 | Park | |
| 2018/0320980 | A1 | 11/2018 | Coban et al. | |
| 2019/0023322 | A1 | 1/2019 | Haselhorst et al. | |
| 2019/0316499 | A1 | 10/2019 | Girondi | |
| 2022/0056823 | A1† | 2/2022 | Kelly | |
| 2022/0074327 | A1 | 3/2022 | Kelly et al. | |
| 2022/0266179 | A1 | 8/2022 | Yadav et al. | |
| 2023/0061996 | A1 | 3/2023 | Kelly et al. | |
| 2023/0243282 | A1 | 8/2023 | Perotto et al. | |
| 2023/0243283 | A1 | 8/2023 | Kelly et al. | |
| 2023/0287813 | A1 | 9/2023 | Chen et al. | |
| 2024/0060435 | A1 | 2/2024 | Kelly et al. | |

FOREIGN PATENT DOCUMENTS

| | | | |
|---|---|---|---|
| KR | 20080073009 | A | 8/2008 |
| KR | 101735210 | B1 | 5/2017 |
| WO | 2006005328 | A1 | 1/2006 |

OTHER PUBLICATIONS

Thomas Weidler and Lothar H. Kallien, "Using Gas Injection in High Pressure Die Casting Technology", Die Casting Engineer, May 2009, pp. 50-52.

Chinese Office Action dated Dec. 21, 2022 for Chinese Patent Application No. 202110968161.X. English translation attached.

Chinese Office Action dated Jul. 27, 2023 for Chinese Patent Application No. 202110968161.X. English translation attached.

You Tube, titled "Highlighted Part: Engine Oil Cooler Mount for Select Ford F-Series Models" by @DormanProducts, published on Sep. 13, 2017 ("Dorman"). Dorman may be accessed at https://www.youtube.com/watch?v=Tqk05R9hlsQ.

Website: https://www.amazon.com/Replacement-Assembly-68105583AF-68105583AE-Chrysler.dp/B086M57NM3?source=ps-sl-shoppingads-lpcontext&ref=fplfs&psc=1&smid=A3Q5WB1U3AUUOV "MangoS Replacement for Engine Oil Filter Cooler Housing Adapter Assembly 68105583AF 68105583AE for 2014 2015 2016 2017 Chrysler Ram Grand Wrangler 3.6L V6 (Year: 2000)".

Website: https//ww.amazon.com/ONER-68105583AA-68105583AC-68105583AD-68105583A%EF%BC%8C68105583AF/dp/B08937GMZK?source=ps-sl-shopingads-lpcontext&ref=fplfs&smid=A3S3892600WGZD&TH=1 "ONER Engine Oil Cooler and Oil Filter Housing Adapter Assembly, Fit for 2014-2017 Chrysler 200/300 Dodge Jeep Ram 3.6L V6 Engine, Replaces # 68105583AA, 68105583AC, 68105583AD, 68105583A, 68105583AF (Year: 2020)".

Oil Filter Housing Patent Photos.

Website: http://amazon.com , "Oil Filter Adaptor Housing Assembly 68105583AF, 68105583AE Fits 2014-2018 Chrysler 200 300 Town Country Dodge Challenger Charger Grand Cherokee Ram ProMaster 1500 3.6 V6 Oil Cooler Kit" (Year 2019).

Website: https://www.amazon.com, "Engine Oil Cooler and Filter Housing Adapter Kit 68105583AF 68105583AE Replacement for Chrysler Dodge 3.6L V6 Vehicles 200 Town & Country Grand Caravan Wrangler Ram" at least as early as Jan. 1, 2020.

Kallien, et al., "Pressure die castings with functional cavities produced by gas injection" published in journal International Foundry Research/Giessereiforschung, vol. 58, No. 4, published no later than Dec. 21, 2006.

Website; https://dodgeforum.com/forum/jeeps/428670-pentastar-3-61-oil-leak-problem-done.html. Screen shots of website pp. 1-5.

Dorman Products Part No. 918-428, offered for sale at website: Engine Oil Cooler (https://www.dormanproducts.com/p-133319-918-428.aspx). First posted on website Feb. 13, 2021. 6 pages.

Dorman Products Part No. 918-432, offered for sale at website: Engine Oil Cooler (https://www.dormanproducts.com/p-98680-918-432.aspx). First posted on website Oct. 28, 2017. 6 pages.

"SI B11 14 15 Engine Oct. 2015 Technical Service", pp. 1-4 copyright: 2015, BMW of North America, Inc., Available on NHTSA: https://static.nhtsa.gov/odi/tsbs/2016/MC-10150903-9999.pdf.†

Thomas Weidler and Lothar H. Kallen, "Using Gas Injection in High Pressure Die Casting Technology", pp. 50-52, Publication date appears to be May 2009, Die Casting Engineer.†

* cited by examiner
† cited by third party

METHOD AND PROCESS FOR MANUFACTURING A UNITARY OIL FILTER ADAPTOR

CROSS REFERENCE TO RELATED APPLICATIONS

This application claims the benefit of U.S. application Ser. No. 17/985,565, which was filed on Nov. 11, 2022; U.S. application Ser. No. 17/528,884, which was filed on Nov. 17, 2021; U.S. application Ser. No. 17/406,639, which was filed on Aug. 19, 2021; and, U.S. Provisional Application No. 63/068,759, filed on Aug. 21, 2020, each of which is incorporated herein by reference as if fully set forth herein.

FIELD OF INVENTION

The invention relates generally to the lubrication of mechanical engines that utilize oil as a lubricating fluid that circulates though defined galleries in the engine. More particularly, the invention relates to a lubrication system where the lubricating fluid is routinely passed through a filter element, which is generally replaceable at certain intervals, and potentially and oil cooler. Most particularly, the invention relates to an adaptor for a lubrication system that incorporates the oil filter housing and an oil cooler in an assembly that is often located within the motor valley.

BACKGROUND

Modern engines, especially though used in motor vehicles, seek to reduce weight and size while maintaining the desired power. As part of the effort to reduce weight, many parts are being made in plastic and many parts are being combined in assemblies to further reduce weight by eliminating individual connection points. While this trend has proven successful in some areas, it has introduced problems where one or more portions of a plastic assembly experience a failure. Under these conditions, it is often necessary to disassemble unrelated parts of the engine in order to gain access to the assembly and make the necessary repairs.

Another drawback to plastic assemblies is the need to made accommodations for various sensors and system components that need to be connected to the assembly. These connections are most often achieved by molding an opening in the plastic component and attaching a metallic insert to achieve the connection. This plastic to metal connection can be difficult to properly seal. An addition failure point of this metal-plastic connector is the possibility of over tightening the inserted component, such as a sensor fitting or cap, and stressing or damaging the surrounding plastic.

In addition to the above associated with a hybrid plastic-metallic assembly, the molding process requires certain concessions in order to permit molding cores to be inserted and removed during the molding process. An associated drawback with the plastic molding is the need to remove core elements used in the process and reseal the molding which leads to further potential failure points. In addition, the unused molded openings that require closing plugs that must be glued or welded in the unused openings. These plugs represent another failure point in the plastic-metallic assembly.

SUMMARY

The applicants have discovered that a cast metallic part provides a robust assembly that avoids the needs for inserts, eliminates the need for plugs, and provides for direct threading of components to the adaptor. As a result of eliminating the assembly of multiple molded parts, the performance and durability is improved against burst pressure, heat and age degradation, and conditions related to cycling. In addition, the single metallic casting provides a flow path without the need for adhesives and resealing of the flow path.

DETAILED DESCRIPTION

Figure 1:
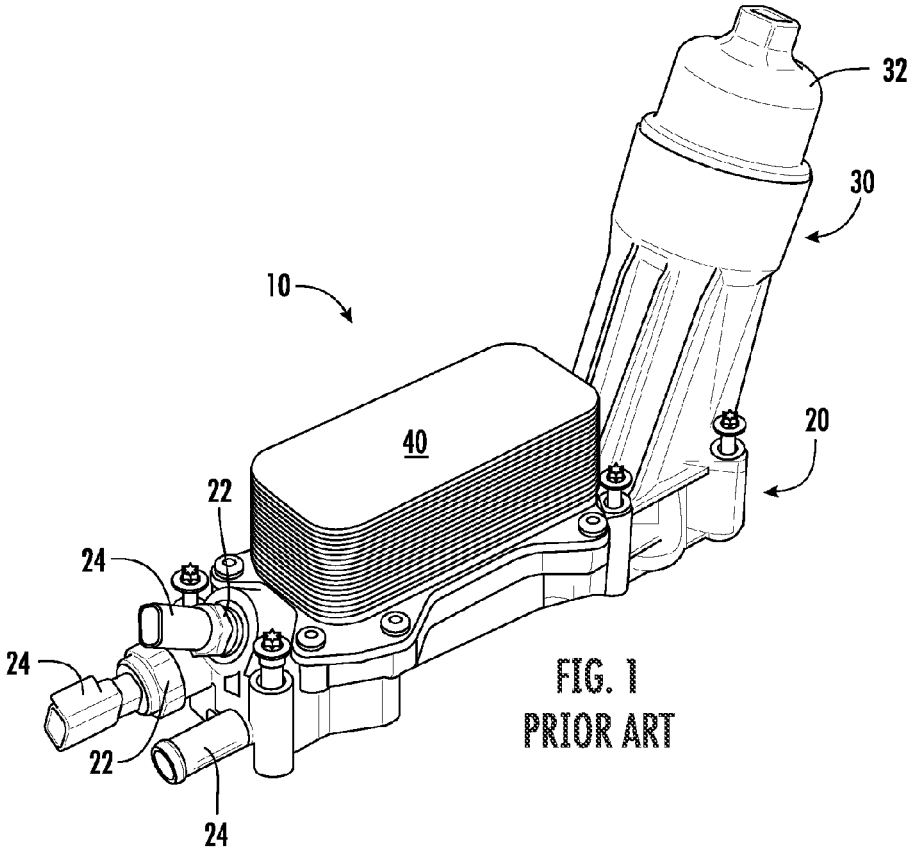
FIG. 1 PRIOR ART
FIG. 1 is a perspective view of a prior art oil filter adaptor and cooler assembly.

The prior art oil filter assembly shown in FIGS. 1-3B is typical of the adaptor construction resulting from using moldable plastic materials. The prior art assembly 10 in FIG. 1 has a base 20, a filter housing 30 and an oil cooler 40. The base 20 includes medal inserts 22 that are provided in the plastic construction at designated locations for the attachment of other associated components. The metal inserts and associated components are shown in FIG. 1 at 22 and 24 respectively. Although the metal inserts are frequently molded in situ during the molding of the plastic base, they remain a failure point and can result in oil leakage or worse. The metal inserts 22 are also subject to overtightening during attachment of the associated components 24, which can result in stress cracks in the plastic.

Figure 2:
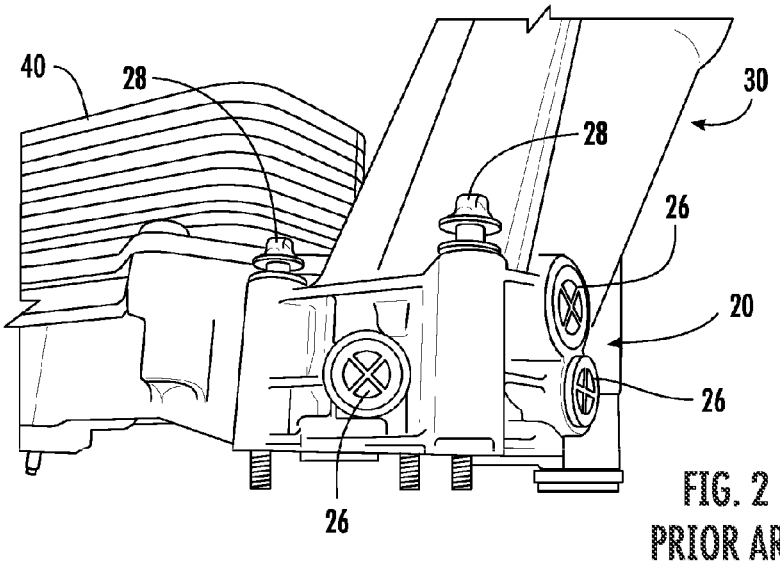
FIG. 2 PRIOR ART
FIG. 2 is a partial rear view of the prior art assembly in FIG. 1.

As shown in FIG. 2, the base 20, due to the molding process requiring the ability to withdrawal a core, has a number of plugs 26 that are retrofitted after the base 20 is molded. The plugs 26 are assembled to the molded base with an adhesive or spin welding. In either event, the plugs 26 are a failure point in the base 20 that can result in oil leaking or worse.

In addition to the inserts 22 and plugs 26, the base 20 has a number of metal inserts or sleeves, not shown, that are inserted to reinforce the plastic molded apertures for attachment of the various bolts 28 that hold the assembly 10 together. Here again, the inserts or sleeves introduce a potential failure point. Another potential failure point is the attachment of the cap 32 to the plastic filter housing 30. Over tightening of the cap 32 can introduce stress fracture in the threaded housing 30.

Figure 3A:
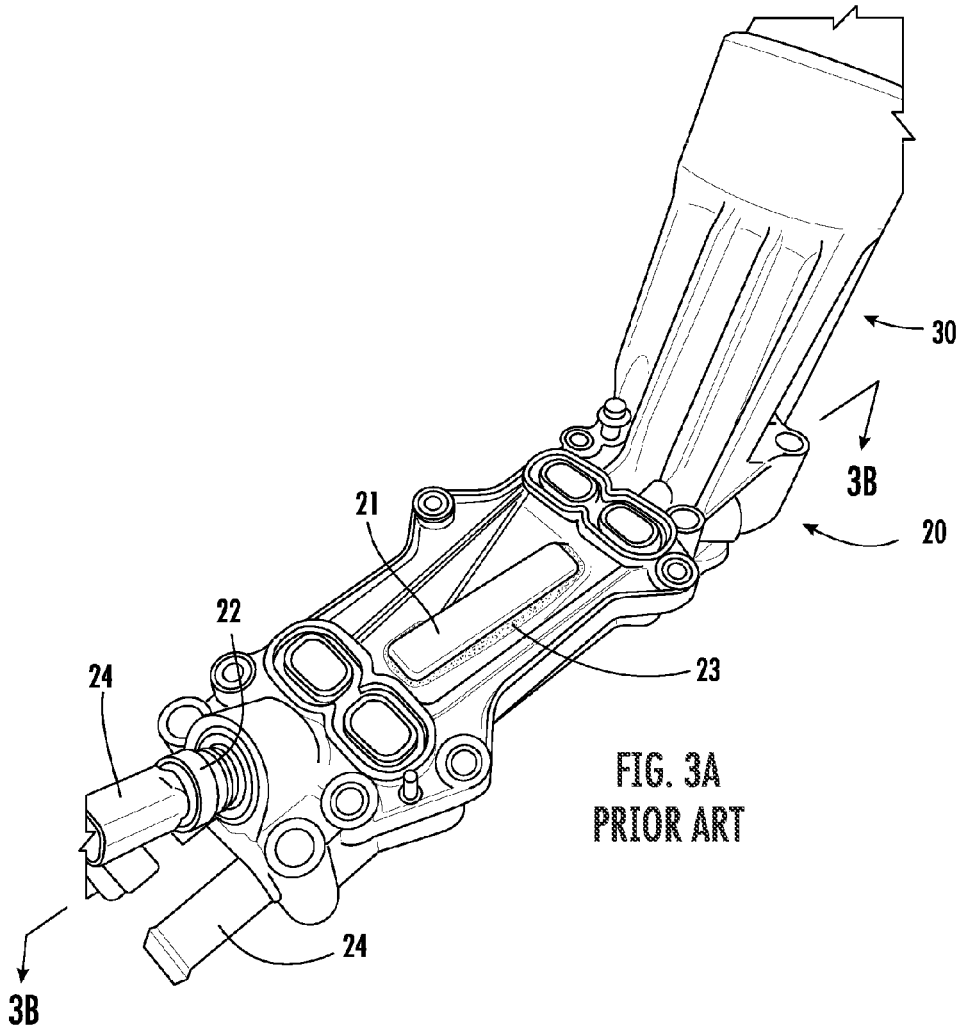
FIG. 3A PRIOR ART
FIG. 3A illustrates the capping of the oil flow path in the prior art adaptor after removal of the core used in the plastic molding.
Figure 3B:
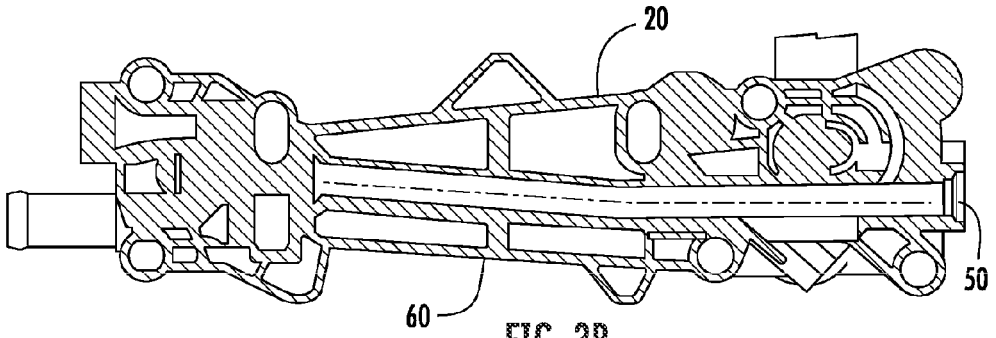
FIG. 3B PRIOR ART
FIG. 3B is a section illustrating the flow path in the prior art adaptor.

With reference to FIGS. 3A and 3B, it can be seen that the prior art flow path 50 requires a cover 21, at least partially over the flow path, that is adhered to the base after the molding core is removed by the adhesive or welding 23. With reference to FIG. 4B, it can be seen that the flow path 50 bends or is angular; in other word, the flow path 50 does not have a common longitudinal axis.

Figure 4:
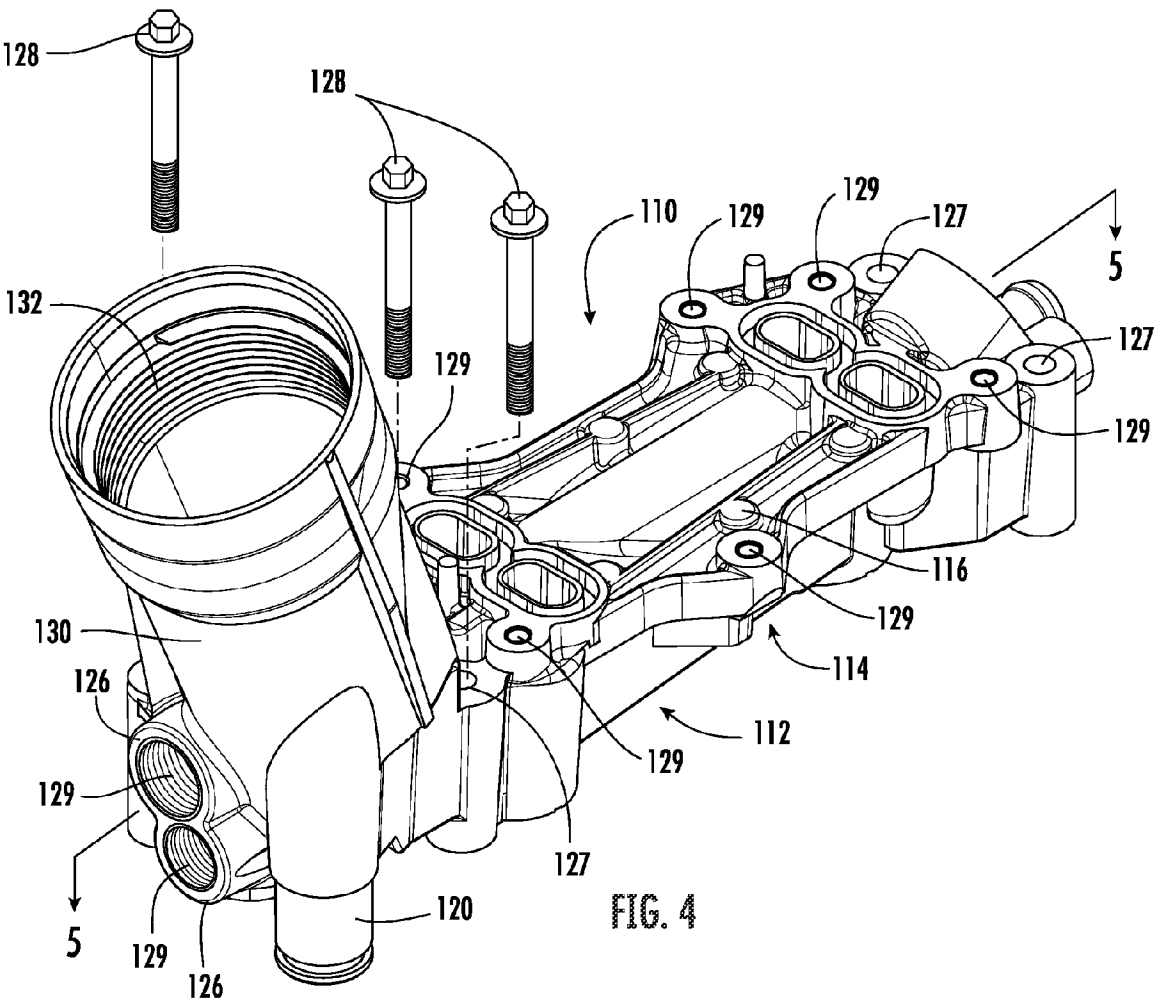
FIG. 4 is a perspective view of an adaptor according to the invention prior to assembly of any related components.

With reference to FIG. 4, the preferred adaptor 110 has an elongated body 112, which has a lower surface 114 that mates with a lubrication network and an upper surface 116 that mates with a cooling component, a filter housing 130 and base 120 that is formed of a casted metallic material, preferably aluminum. The elongated body 112, base 120 and the filter housing 130 are casted together and the apertures 127 for receiving the bolts 128 do not required metal inserts or sleeves to avoid stressing or cracking do to the solid metallic construction. The casting is also threaded at 129 to receive fasteners for securing an oil cooler 40 and external connectors to the adaptor 110.

Still with reference to FIG. 4, the casted filter housing 130 has internal threaded 132 that mate with an OEM cap 32 to secure a filter within housing 130. In a similar manner, the apertures 126 have internal threading to preferably mate with NPT plugs that are self-sealing. Depending on the type and construction of related components, such as sensors, it may be necessary to employ a gasket or sealing rings with their assembly.

Figure 5:
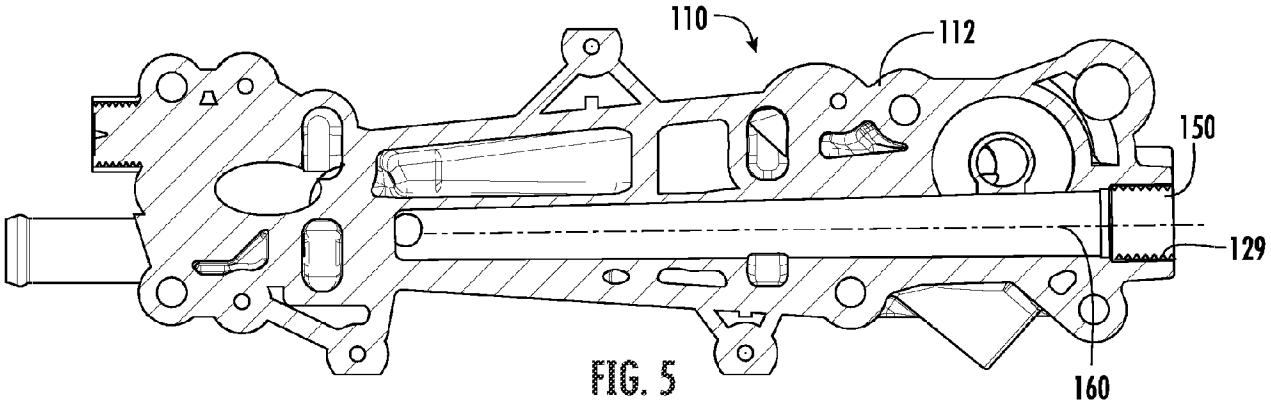
FIG. 5 is a section view along the line 5-5 in FIG. 4 showing the linear flow path in an adaptor according to the invention; and, FIG. 6 is a perspective view of an adaptor according to the invention in a direction opposite to that of FIG. 4.

With reference to FIG. 5, the flow path 150 for transporting the lubricant within base 120 to connect with the internal lubrication network is centered about the longitudinal axis 160 and consistent throughout the base 120. The flow path 150 is symmetric about the axis 160 and there is no angular component in the flow path 150 as it is connected with the internal lubrication network. The flow path 150 is entirely within the unitary casting so there is no need for adding a closure to the flow path.

With the exception of the flow path 150, the lubrication galleries and the location positions for associated components are identical to the OEM assembly so the casted metal adaptor is a direct replacement for the OEM part and no modifications or relocations of other components are necessary.

Figure 6:
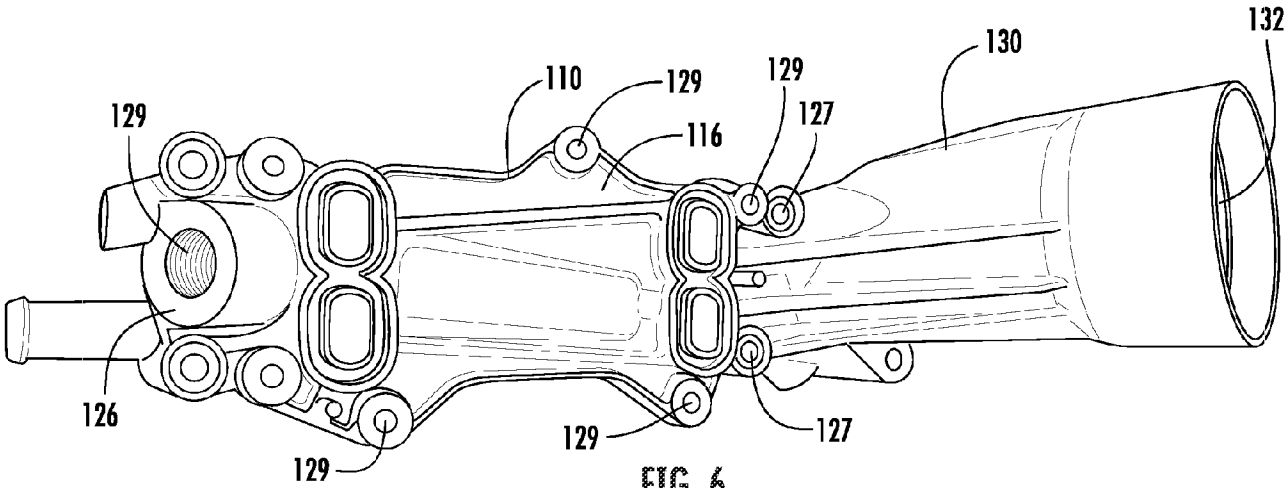

As shown in FIGS. 4 and 6, the adaptor 110, including the filter housing 130 and the base 120 outwardly appearance the same as the OEM part and the base accepts the OEM cooler 40 and the filter housing accepts the cap 32 without any modification.

What is claimed is:

1. A method for manufacturing a unitary metallic adaptor for an engine lubrication system, the method comprising:
- casting an elongated unitary metallic body comprising:
  - a filter housing at a first end of the elongated unitary metallic body;
  - a lower surface configured to mate with the engine lubrication system;
  - an upper surface between the filter housing and a second end of the elongated unitary metallic body, wherein the upper surface is configured to mate with a lubrication cooler;
  - a lubrication flow path within the elongated unitary metallic body, wherein the lubrication flow path extends between the filter housing and the second end to facilitate fluid flow between the engine lubrication system and the filter housing; and,
  - a plurality of casted apertures in at least one end of the elongated unitary metallic body; and
- threading at least one of the plurality of casted apertures for mating with a respective threaded member.

2. The method of claim 1, further comprising:
- threading each remaining casted aperture of the plurality of casted apertures for mating with a respective threaded member.

3. The method of claim 1, wherein
- the lubrication flow path extends along a common longitudinal axis with the elongated unitary metallic body.

4. The method of claim 1, wherein the elongated unitary metallic body further comprises a plurality of apertures in the upper surface for attaching a lubrication cooler.

5. The method of claim 4, further comprising:
- threading each of the plurality of apertures in the upper surface.

6. The method of claim 1, further comprising:
- providing threads in the filter housing to receive a thread closure.

7. The method of claim 6, wherein the elongated unitary metallic body further comprises a plurality of threaded apertures in the upper surface for attaching a lubrication cooler.

8. A method for manufacturing an adaptor for an engine lubrication system, the method comprising:
- casting a unitary metallic body comprising:
  - a filter housing at a first end of the unitary metallic body;
  - a lower surface of the unitary metallic body configured to mate with the engine lubrication system;
  - an upper surface of the unitary metallic body between the filter housing and a second end of the unitary metallic body, wherein the upper surface is configured to mate with a lubrication cooler;
  - a lubrication flow path that extends within the unitary metallic body to connect the engine lubrication network and the filter housing; and
  - a casted aperture in the unitary metallic body; and,
- internally threading the casted aperture for mating with an externally threaded member.

9. The method of claim 8, wherein the unitary metallic body further comprises one or more additional casted apertures, the method further comprising:
- threading each of the one or more additional casted apertures for mating with a respective threaded member.

10. The method of claim 8, further comprising:
- providing a plurality of apertures in the upper surface for attaching a lubrication cooler.

11. The method of claim 10, further comprising:
- threading each of the plurality of apertures in the upper surface for attaching a lubrication cooler.

12. An adaptor for an engine lubrication system, the adaptor comprising:
- a single-cast metallic body comprising:
  - a filter housing at a first end of the single-cast metallic body;
  - a lower surface of the single-cast metallic body configured to mate with an engine lubrication system;
  - an upper surface of the single-cast metallic body between the filter housing and a second end of the single-cast metallic body is configured to mate with a lubrication cooler;
  - a lubrication flow path extending within the single-cast metallic body between the filter housing and the second end of the single-cast metallic body to connect the lower surface of the single-cast metallic body with the filter housing; and
  - an internally-threaded casted aperture for mating with an externally threaded member.

13. The adaptor of claim 12, further comprising one or more additional casted apertures in the single-cast metallic body.

14. The adaptor of claim 13, wherein the one or more additional casted apertures are internally threaded casted apertures for mating with a respective externally threaded member.

15. The adaptor of claim 13, wherein the one or more additional casted apertures are in the upper surface for mating with a lubrication cooler.

16. The adaptor of claim 15, wherein the one or more additional casted apertures are internally threaded casted apertures for mating with a respective externally threaded member of the lubrication cooler.

17. The adaptor of claim 12, wherein the lubrication flow path is centered extends along a common longitudinal axis with single-cast.

18. An adaptor for an engine lubrication system comprising:

a single-cast metallic body comprising:

a filter housing at a first end of the single-cast metallic body;

a first surface configured to mate with an engine lubrication system;

a second surface between the filter housing and a second end of the single-cast metallic body, wherein the second surface is configured to mate with a lubrication cooler;

lubrication flow path within the single-cast metallic body that connects the first surface with the filter housing; and an internally threaded casted aperture configured to mate with an externally threaded member.

* * * * *